US008807277B1

(12) United States Patent
Reyna Lerma et al.

(10) Patent No.: US 8,807,277 B1
(45) Date of Patent: Aug. 19, 2014

(54) SHOE BRACKET ASSEMBLY FOR ATTACHMENT TO A BOTTOM OF A RAIL OF LADDER

(71) Applicants: Arturo Reyna Lerma, Monterrey (MX); José Alfredo Salazar García, Apodaca (MX)

(72) Inventors: Arturo Reyna Lerma, Monterrey (MX); José Alfredo Salazar García, Apodaca (MX)

(73) Assignee: Louisville Ladder Inc., Louisville, KY (US)

( * ) Notice: Subject to any disclaimer, the term of this patent is extended or adjusted under 35 U.S.C. 154(b) by 0 days.

(21) Appl. No.: 13/896,902

(22) Filed: May 17, 2013

(51) Int. Cl.
*E06C 7/46* (2006.01)
*E06C 7/42* (2006.01)

(52) U.S. Cl.
CPC ..... *E06C 7/42* (2013.01)
USPC ..... 182/111; 182/108

(58) Field of Classification Search
CPC ..... E06C 7/46
USPC ..... 182/108, 111
See application file for complete search history.

(56) References Cited

U.S. PATENT DOCUMENTS

| | | | | |
|---|---|---|---|---|
| 2,449,609 | A | 9/1948 | Linder | |
| 2,691,479 | A | 10/1954 | Sharp | |
| 3,456,757 | A | 7/1969 | Sain | |
| 4,415,062 | A | 11/1983 | Shaw | |
| 5,154,255 | A | 10/1992 | Kiska et al. | |
| 5,370,203 | A | 12/1994 | Kiska | |
| 5,791,439 | A * | 8/1998 | Plotner et al. | 182/219 |
| 7,516,817 | B2 * | 4/2009 | Pate et al. | 182/217 |
| 7,837,010 | B2 * | 11/2010 | Astor | 182/220 |

* cited by examiner

*Primary Examiner* — Alvin Chin-Shue
(74) *Attorney, Agent, or Firm* — Egbert Law Offices, PLLC

(57) ABSTRACT

A shoe bracket assembly for attachment to a bottom of a rail ladder has a channel member and a bracket affixed to a side wall of the channel member. The bracket is positioned between end walls of the channel member. The bracket has a central portion with a first flange and a second flange extending outwardly therefrom so as to be affixed to the side wall of the channel member. The bracket has a third flange and a fourth flange extending outwardly from the central portion so as to be in spaced relationship to side wall of the channel member. The lower end of the rail is received within the space. The third and fourth flanges extend in a plane and parallel relationship to a plane of the first and second flanges. The central portion has a hole formed therethrough in axial alignment with the hole of the channel member.

20 Claims, 4 Drawing Sheets

SHOE BRACKET ASSEMBLY FOR ATTACHMENT TO A BOTTOM OF A RAIL OF LADDER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to ladder assemblies. More particularly, the present invention the relates to shoe bracket assemblies that are used at the bottom of the rail of ladder so as to securely position the ladder with respect to an underlying surface.

2. Description of Related Art Including Information Disclosed Under 37 CFR 1.97 and 37 CFR 1.98

Ladders are conventionally utilized to provide a user thereof with improved access to elevated locations that might otherwise be inaccessible. Ladders come in many shapes and sizes, such as straight ladders, straight extension ladders, stepladders, and combination step and extension ladders.

Ladders known as straight ladders or straight extension ladders are ladders that are conventionally positioned against an elevated surface, such as a wall or the edge of a roof, to support the ladder at a desired angle. A user then ascends the ladder to obtain access to an elevated area, such as access to an upper area of the wall or access to the roof. Straight ladders and straight extension ladders are referred to as being "straight" because their rails are typically straight and generally parallel to one another throughout the length of the ladder. A pair of feet or pads, one being coupled to the bottom of each rail, are conventionally used to engage the ground, a floor or some other supporting surface.

A ladder foot commonly comprises a U-shaped shoe pivotally coupled by a pin to the bottom of a rail of a ladder in a manner whereby the shoe is angularly adjustable between flat, toe-down and intermediate positions. In the flat position, the bottom of the shoe rests on the ground or other footing to provide maximum adhesion to smooth flat surfaces, such as asphalt, wood, concrete, etc. In the toe-down position, the shoe is tilted to have its front part contact the ground and serve as a pick-like device to provide maximum penetration and holding power on ice or hard, soft, sandy, or frozen earth.

In the past, it has been a common practice for the shoe of a ladder foot to be coupled to a rail of the ladder by a pin-and-slot coupling wherein the pin is passed laterally through a hole in the rail to be translationally fixed in relation thereto, and wherein the pin has opposite ends projecting out from laterally opposite sides of the ladder rail, and those opposite ends of the pin are received in two slots respectively formed in the two sidewalls of the U-shaped shoe.

A ladder foot of such construction has, however, a number of disadvantages for use in present day ladders. In order to provide ladders that are inexpensive, light in weight, and durable, the rails thereof are often in the form of lengths of fiberglass of U-shape in cross section so as to have a central, longitudinal elongated relatively thin web and, also, two longitudinally elongated side flanges projecting out in the same direction from the opposite sides of the web. Such rails do not lend themselves readily to a pin-and-slot coupling of a shoe to the rail wherein the two slots are in the shoe and the pin passes through a hole in the web of the rail to be translationally fixed in relation thereto. That is so, because, in view of the thinness of the fiberglass web, it would be difficult to maintain the bolt fixed in its normal alignment to the web and, because of the web thinness and the lack of mechanical strength of the fiberglass web, the transmission of half the weight of the ladder and its occupant from the web to the pin would create undue stresses in the region of the web near the pin.

In another consideration, the provision of pivotally mounting the shoe to the ladder rail by a pin-and-slot coupling wherein slots are formed in the sidewalls of the shoe has the disadvantage that the slots take up substantial space in the shoe's sidewalls in which the slots must be surrounded with a sufficient thickness of sidewall material throughout the length of the slot to withstand the mechanical strain imposed on each sidewall when the shoe is bearing substantial weights. This means, however, that each of the sidewalls of the shoe must be larger in dimension than is really necessary.

In the past, various patent have issued relating to ladder shoes and ladder shoe bracket assemblies. An early patent is that of U.S. Pat. No. 2,449,609, issued on Sep. 21, 1948 to O. A. Linder. This patent shows a rectangular plate secured of the lower leg of the ladder. Vertical flanges border the plate. A U-shaped member is slidably mounted within the flanges. A resilient means retains the sliding member upwardly retracted between the flanges. A bracket is secured to the sliding member. A T-shaped member is carried by the bracket such that the leg of the T is in an outwardly extended position. A cylindrical tube is secured to the sliding member. A ground engaging foot is resiliently carried within the tube. The T-leg is adapted to be lowered and locked against the resilient means to position the foot in an extended ground-engaging position.

U.S. Pat. No. 2,691,479, issued on Oct. 12, 1954 to J. E. Sharp, describes a ladder shoe. This ladder shoe is adapted to be pivotally and shiftably attached to the base of ladder rail upon a bolt projecting through the ladder rail above its base edge. The bottom carries an anti-slip tread on its underside and a spike at one end thereof. A pair of parallel side walls upstanding from the bottom and spaced apart sufficiently receive the ladder rail base therebetween. Relatively aligned apertures in the side walls allow the attaching bolt to extend therethrough. The apertures are elongated to permit shifting of the shoe upon the bolt.

U.S. Pat. No. 3,456,757, issued on Jul. 22, 1969 to B. S. Sain, describes a ladder stabilizer boot. The ladder legs are securely deposited in adjustable sleeve or channel. The sleeve is swivelly mounted on the boot along various angles. The boot has a base formed with a horizontal flange which is provided with ground-gripping means including holes through which anchoring pins may be driven. The sleeve is adapted to receive the ladder leg and is provided with bolts to penetrate holes in the ladder legs so as to secure it firmly to the sleeve.

U.S. Pat. No. 4,415,062, issued on Nov. 15, 1983 to J. L. Shaw, discloses a ladder foot having a bracket attached at its upper end to a ladder rail and includes a stud extending downwardly from this end. A shoe has a central sole plate and a pair of upper plates extending from the sole plate to straddle opposite sides of the bracket. A pin is fixedly secured with the upper plates and passes from one to the other through the bracket adjacent the front side of the stud. The downward extent of the stud includes an upper range within which the stud fits between the pin and sole plate in such manner that the shoe is locked in toe-down position. There are portions integrally joined with the stud so as to serve as stops for the pin.

U.S. Pat. No. 5,154,255, issued on Oct. 13, 1992 to Kiska et al., teaches a ladder shoe and method of use. The ladder shoe has a shoe body having a first side plate, a second side plate and a base. The first side plate and the second side plate are attached to the base. The side plates include curved slots through which a fastener is disposed and which movably connects the ladder shoe to the end of the side rail of the ladder. This allows the ladder shoe to move between a first position where the base is at a first angle with respect to the side rail and a second position where the base is at a second angle with respect to the side rail. Each slot has a notch in which the fastener catches causing the shoe to be maintained in an intermediate position until the shoe body is desired to be placed into another position. The base has a bottom which provides a slip-resistant surface for engaging the shoe body to essentially flat surfaces when the shoe body is in the first position.

U.S. Pat. No. 5,370,203, issued on Dec. 6, 1994 to S. A. Kiska, shows a ladder shoe spur plate. The ladder shoe has a base. This base has an elongate portion having a first side and a second side, a first edge and a second edge, and a top face and a bottom face. The top face is attached to the ladder rail attachment portion. The base has a foot pad. The base includes of a blade portion extending from the first edge. The base has a first flange portion extending from the bottom face and integrally connected thereto. There is also a second flange portion extending from the bottom face and integrally connected thereto. The base further includes a third flange portion extending from the bottom face and integrally connected thereto. A fourth flange portion extends from the bottom face and is also integrally connected thereto. The first, second, third and fourth flange portions form a pocket in which the footpad is held along the bottom face and sides of the footpad.

It is an object of the present invention to provide a shoe bracket assembly that can be preassembled prior to attachment to the ladder.

It is another object of the present invention to provide a shoe bracket assembly that is securely retained at the end of the ladder rail.

It is another object of the present invention to provide a shoe bracket assembly that is easy to repair or replace.

It is another object of the present invention to provide a shoe bracket assembly that provides stronger support to the fragile bottom ends of the ladder rails.

It is still a further object of the present invention to provide a shoe bracket assembly that allows the ladder rail to be securely positioned upon an underlying surface.

It is another object of the present invention to provide a shoe bracket assembly that properly guides the end of the rail into a properly seated position.

It is still a further object of the present invention to provide a shoe bracket assembly that simplifies assembly of the shoe bracket of the ladder.

These and other objects and advantages of the present invention will become apparent from a reading of the attached specification and appended claims.

BRIEF SUMMARY OF THE INVENTION

The present invention is a shoe bracket assembly for attachment to a bottom of a rail of a ladder. The shoe bracket assembly includes a channel member having a side wall, a first end wall and second end wall. The first end wall and the second end wall extend in generally transverse relationship to the side wall. The channel member has a hole formed therethrough. A bracket is affixed to a side wall of the channel member and positioned between end walls of the channel member. The bracket has a central portion having a first flange and a second flange extending outwardly therefrom. The first flange and the second flange are affixed to the side wall of the channel member. The bracket has a third flange and a fourth flange extending outwardly from the central portion. The third flange and the fourth flange are positioned in spaced relationship to the side wall so as to define a space therebetween. The third and fourth flanges extend in a plane and in parallel relationship to a plane of the first and second flanges. The central portion has a hole formed therethrough in axial alignment with the hole of the channel member.

The central portion of the bracket has a shoulder formed therein at a location adjacent the first and second flanges. The first and second flanges are riveted to the side wall of the channel member. The third and fourth flanges each have a hole formed therethrough.

The shoe bracket assembly of the present invention also has a foot having a bottom surface. The foot has a first surface and a second surface extending upwardly from the bottom surface. Each of the first and second surfaces have an opening formed therein. The first surface is positioned adjacent a side wall of the channel member. The second surface is positioned adjacent the central portion of the bracket. An axle extends through the openings of the first and second surfaces and through the hole in the side walls of the channel member and the hole in the central portion of the bracket. Each of the first and second openings comprise an elongated slot extending along the respective surfaces of the foot. In the preferred embodiment of the present invention, axle is a bolt having a head bearing against one of the first and second surfaces and a nut bearing against the other of the first and second surfaces. The elongated slot has a longitudinal axis extending at a non-transverse acute angle with respect to the bottom surface. The foot can have a polymeric or elastomeric gripping surface attached to the bottom of the foot.

When the shoe bracket assembly is attached to the rail of ladder, the channel member will have the first end wall positioned adjacent to the first end side of the ladder. The second end wall of the channel will be positioned adjacent to the second end side of the rail. The side wall of the channel member is positioned adjacent to the central side of the rail. The bottom edge of the rail will extend in the space between third and fourth flanges and the side wall of the channel member. The bottom edge of the rail will rest on a shoulder formed in the bracket adjacent to the first and second flanges.

The side wall of the channel member includes a first hole and a second hole formed therein. The third and fourth flanges each have a hole formed therein. The first and second holes of the channel member are aligned respectively with the holes of the third and fourth flanges. A first fixing member extends through the central side of the rail and through the first hole of the channel member and through the hole of the third flange. A second fixing member extends through the central side of the rail and through the second hole of the channel member and through the hole of the fourth flange. The side wall of the channel member is riveted to the central side of the rail. The bottom edge of the rail bears against the shoulder of the bracket. The hole of the central portion of the bracket and the hole of the channel member positioned below and in spaced relation to the bottom edge of the rail.

The foregoing Section is intended to describe, in generality, the preferred embodiment of the present invention. It is understood that modifications to this preferred embodiment can be made within the scope of the present invention. As such, this Section should not to be construed, in any way, as limiting of the scope of the present invention. The present invention should only be limited by the following claims and their legal equivalents.

DETAILED DESCRIPTION OF THE INVENTION

Figure 1:
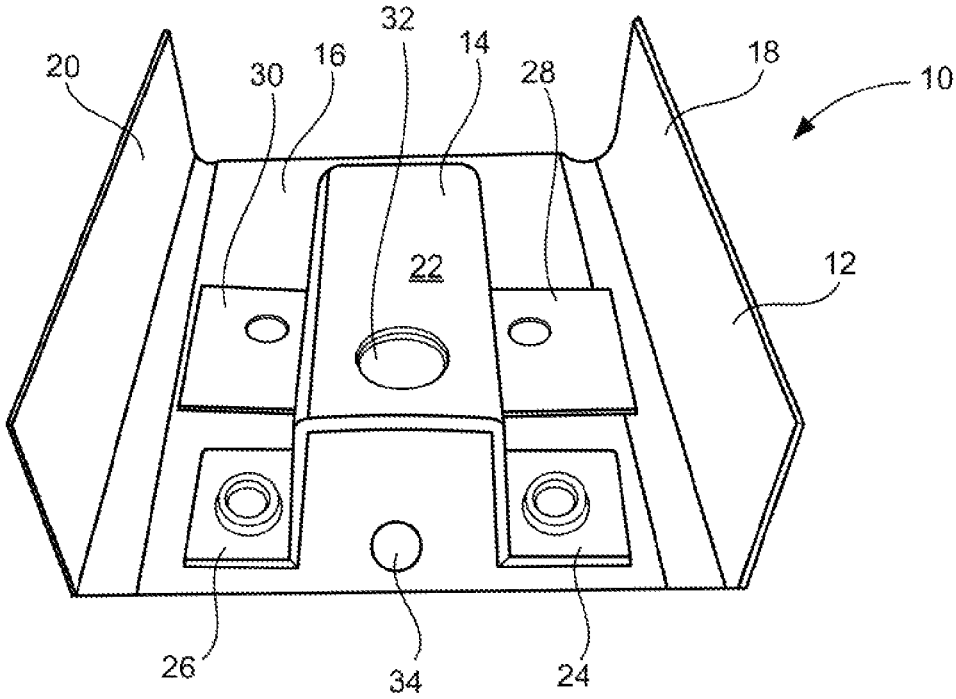
FIG. 1 is a perspective bottom view of the shoe bracket assembly of the preferred embodiment of the present invention.

As can be seen in FIG. 1, there is shown the shoe bracket assembly 10 in accordance of the teachings of the preferred embodiment of the present invention. The shoe bracket assembly 10 is suitable for attachment to a bottom of a rail of a ladder. The shoe bracket assembly 10 includes a channel member 12 and a bracket 14. The channel member 12 has a side wall 16, a first end wall 18, and a second end wall 20. The first end wall 18 and the second end wall 20 extend in generally transverse relationship to the side wall 16. The first end wall 18 and the second end wall 20 are in generally spaced parallel relationship to each other. The ends walls 18 and 20 will be suitable for residing against the first end side and the second end side of a ladder rail. The side wall 16 will be suitable for bearing against the central side of the ladder rail.

The bracket 14 is affixed to the side wall 16 of the channel member 12. The bracket 14 is positioned between the end wall 18 and the end wall 20 of the channel member 12. The bracket 14 has a central portion 22 having a first flange 24 and a second flange 26 extending outwardly therefrom. The first flange 24 and the second flange 26 are affixed by suitable rivets to the side wall 16 of the channel member 12. The bracket 14 also has a third flange 28 and fourth flange 30 extending outwardly of the central portion 22. The third flange 28 and the fourth flange 30 are positioned in spaced relationship to the side wall 16 of the channel member 12 so as to define a space therebetween. As such, the bottom edge of the ladder rail can reside in the space between the third flange 28 and the fourth flange 30 and the side wall 16. The third flange 28 and the fourth flange 30 extend in a plane and in generally parallel relationship to a plane in which the first flange 24 and the second flange 26 extend. It can be seen that there is a hole 32 formed in the central portion 22. The side 16 of the channel member 12 has a hole 34 formed therein. Hole 32 will be axially aligned with the hole 34. As such, the holes 32 and 34 can provide an area through which an axle can extend for the attachment of a foot to the shoe bracket assembly 10.

Figure 2:
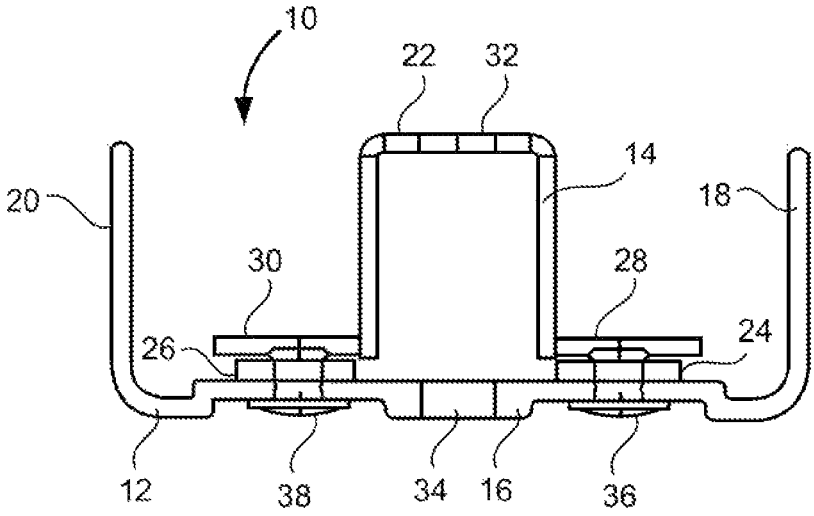
FIG. 2 is an end view of the shoe bracket assembly of the preferred embodiment of the present invention.

FIG. 2 further shows the shoe bracket assembly 10 of the present invention. In FIG. 2, it can be seen that the channel member 12 has side wall 16 and end walls 18 and 20. End walls 18 and 20 are shown in parallel spaced relationship to each other. The end walls 18 and 20 extend in transverse relationship to the side wall 16. The bracket 14 is illustrated as affixed to the side wall 16. The bracket 14 has an inverted U-shaped construction. In FIG. 2, it can be seen that the bracket 14 has the first flange 24 and the second flange 26 extending outwardly therefrom. First flange 24 and second flange 26 are illustrated as bearing on the inside surface of the side wall 16 of the channel member 12. A rivet 36 secures the first flange 24 to the side wall 16. A second rivet 38 secures that the second flange 26 to the side wall 16. Importantly, it can be seen that the third flange 28 and the fourth flange 30 are arranged so as to extend in parallel planar relationship to the first flange 24 and the second flange 26.

The bracket 14 has central portion 22 arranged in spaced relationship to the side wall 16. The hole 32 is formed through the central portion 22. Similarly, the hole 34 is formed through the side wall 16. Holes 32 and 34 are illustrated as in axial alignment. As such, holes 32 and 34 are suitably arranged so as to receive the axle of the foot therein.

Figure 3:
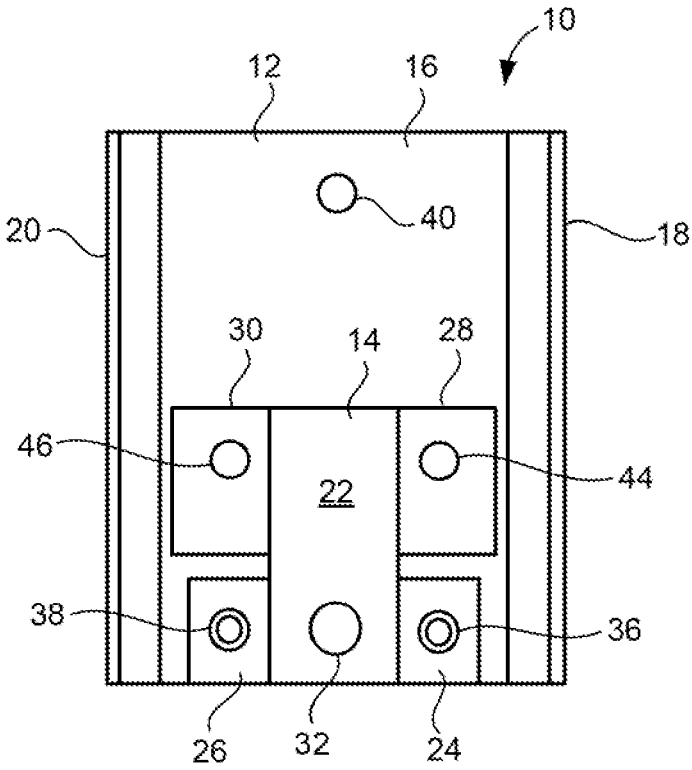
FIG. 3 is a plan view of the shoe bracket assembly of the present invention.

FIG. 3 further shows the shoe bracket assembly 10 of the present invention. In particular, in FIG. 3, it can be seen that the channel member 12 has its side wall 16 formed centrally thereof. The channel member 12 has end walls 18 and 20 extending in parallel relationship to each other. A hole 40 is formed through the side wall 16 generally adjacent to the upper edge of the channel member 12. Hole 40 will be suitable for receiving a pin, rivet, bolt, or other fixing member suitable for attaching the central side of the ladder rail to the side wall 16 of the channel member 12.

In FIG. 3, the bracket 14 is located generally adjacent to the bottom edge of the channel member 12. The bracket 14 includes the central portion 22 having the hole 32 formed therein. The first flange 24 and the second flange 26 extend radially outwardly of the central portion 22. The rivet 36 secures that the first flange 24 to the side wall 16. The second flange 26 is illustrated as having the rivet 38 securing the second flange 26 to the side wall 16. The bracket 14 is further illustrated as having the third flange 28 and the fourth flange 30 extending outwardly of the central portion 22. A hole 44 is formed through the third flange 28. Another hole 46 is formed through the fourth flange 30.

Figure 4:
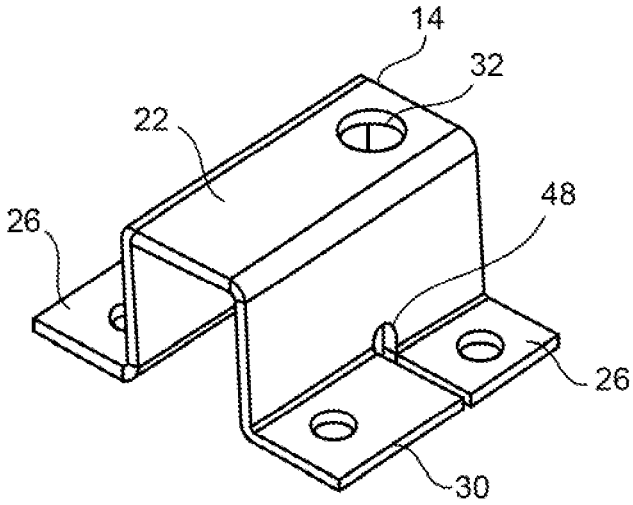
FIG. 4 is a perspective view of the bracket as used in the shoe bracket assembly of the present invention.

FIG. 4 is an isolated perspective view showing the bracket 14. The bracket 14 shows the central portion 22 as having an inverted U-shaped configuration. The hole 32 is formed through the central portion 22. The second flange 26 extends outwardly from the bottom of the central portion 22. The fourth flange 30 is also illustrated as extending outwardly of the bottom of the central portion 22. A shoulder 48 is formed in the area adjacent to the end of the first flange 24 and adjacent to the lower end of the fourth flange 30. A similar shoulder to that of shoulder 48 will be formed in an area adjacent to the first flange 24 and the third flange 28. Shoulder 48 will provide a surface upon which a bottom edge of the rail of the ladder assembly can rest.

Figure 5:
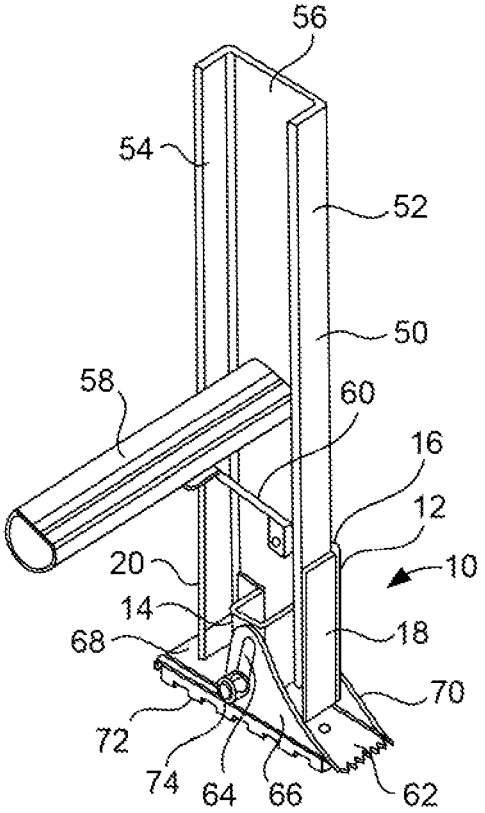
FIG. 5 is an interior perspective view showing the attachment of the shoe bracket assembly of the present invention to the end of the ladder rail.

FIG. 5 shows the manner in which the shoe bracket assembly 10 is affixed to the bottom of a ladder rail 50. Ladder rail 50 has a generally C-shaped cross-section having a first end side 52, a second end side 54, and a central side 56. For illustration purposes, a step 58 is shown as extending from the central side 56 inwardly. A strut 60 provides support for the step 58 and is secured to the central side 56 and to the underside to the step 50.

The shoe bracket assembly 10 is illustrated as having the channel member 12 secured around the bottom end of the ladder rail 50. The channel member 12 has its first end wall 18 positioned against the first end side 52 of the rail 50. The second end wall 20 of the channel member 12 is secured against the outer surface of the second end side 54 of the ladder rail 50. The side wall 16 will be positioned against the outer surface of the central side 56 of the ladder rail 50.

In FIG. 5, it can be seen that there is a foot 62 that is affixed to the bracket 14 of the shoe bracket assembly 10. Foot 62 has an elongated slot 64 formed through a first surface 66 extending upwardly from a bottom surface 68. A second surface 70 also extends upwardly from the bottom surface 68. The surfaces 66 and 70 extend in parallel spaced relationship to each other and also extends in transverse relationship to the bottom surface 68. A polymeric or elastomeric gripping surface 72 is affixed to the bottom surface 68 of the foot 62.

As can be seen in FIG. 5, there is an axle 74 which extends through the elongate slot 64, through the hole 32 and through the hole 34. As such, the axle 74 is suitable for securing the foot 62 to the shoe bracket assembly 10 and, in turn, to the ladder rail 50. The ladder rail 50 will have a bottom edge that will reside against the shoulder 48 in the bracket 14. The axle 74 is illustrated as being in the nature of a bolt which has a nut at one end thereof. This nut will bear against the first surface 66 of the foot 62.

Figure 6:
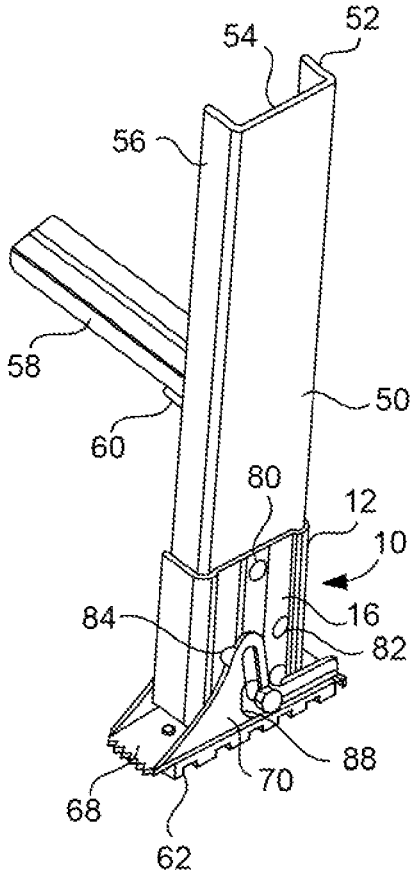
FIG. 6 is an outer perspective view of the attachment of the shoe bracket assembly of the present invention to the ladder rail.

FIG. 6 shows a further view of the assembly of the shoe bracket assembly 10 to the ladder rail 50. The ladder rail 50 is illustrated as having the first end side 52, the second end side 54 and the central side 56. It can be seen that the shoe bracket assembly 10 has channel member 12 that is secured to the lower portion of the ladder rail 50. A rivet 80 extends through the hole 40 of the side wall 16 and is engaged with the strut that supports the step 58. Additional rivets 82 and 84 are engaged with the holes 44 and 46 on the respective third flange 28 and the fourth flange 30. Additional rivets, or other fixing members, are utilized so as to secure the first flange 24 and the second flange 26 to the central side 56 of the ladder rail 50.

In FIG. 6, it can be seen that the second surface 70 extends from the bottom surface 68. The second surface 60 also has an elongated slot 88 extending therealong. The axle 74 is illustrated as in the nature of a bolt having a head which bears against the second surface 70 of the foot 62.

Figure 7:
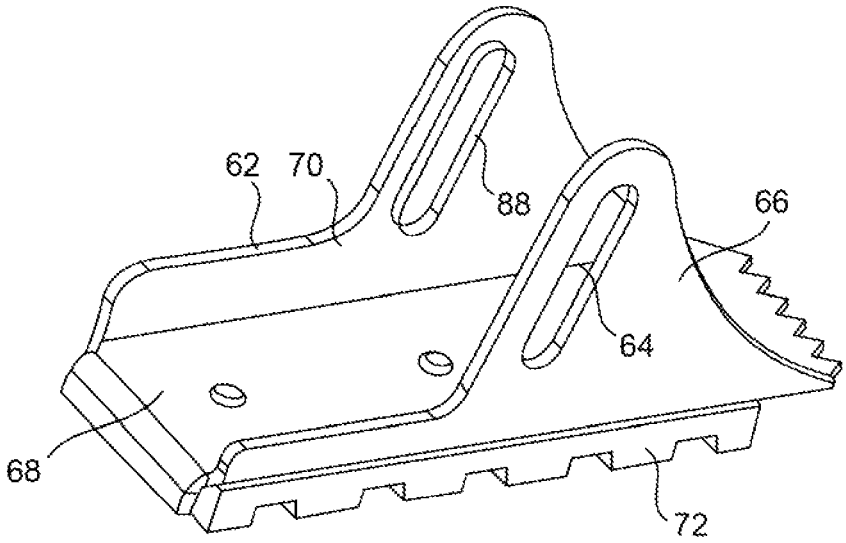
FIG. 7 is a perspective view of the foot as attached to the shoe bracket assembly of the present invention.

FIG. 7 is an isolated view of the foot 62. Foot 62 is illustrated as having the bottom surface 68 formed thereon. The first surface 66 and the second surface 70 extend upwardly from the bottom surface 68 in generally transverse relationship to the bottom surface 68. The elongated slot 64 is formed in the first surface 66. The elongated slot 88 is formed in the second surface 70. The elongated slots 64 and 88 each have a longitudinal axis that extends at an acute angle relative to the bottom surface 68. As such, the elongated slots 64 and 68 allow for the proper positioning of the foot 62 with respect to the ladder. The gripping surface 72 is affixed by suitable fasteners to the bottom surface 68.

Figure 8:
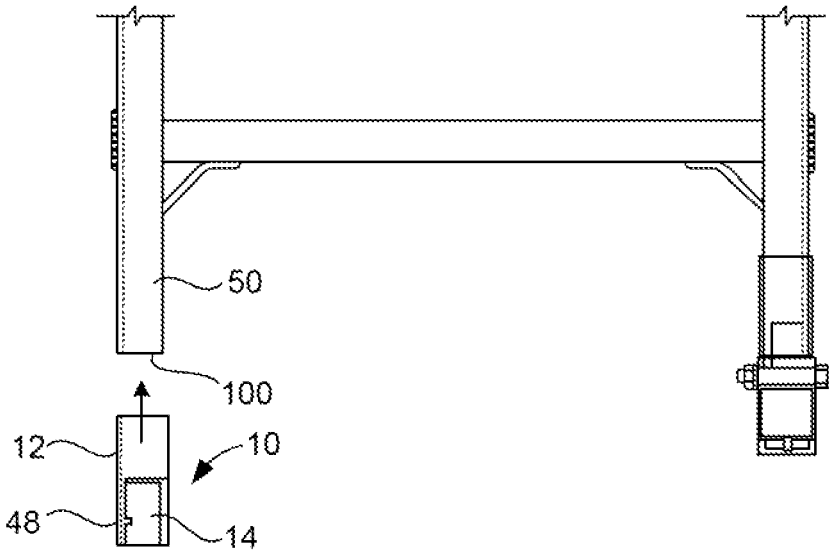
FIG. 8 is an illustration of an initial step for the attachment of the shoe bracket assembly of the present invention to the bottom edge of a rail of a ladder.

FIG. 8 illustrates the assembly of the shoe bracket assembly 10 to the bottom edge 100 of the ladder rail 50. In particular, the channel member 12 has the bracket 14 affixed thereto prior to installation. The shoulder 48 is formed in the bracket 14 so as to provide a surface against which the bottom edge 100 of the ladder rail 50 can fit. The channel member 12 is moved upwardly such that the bottom edge 100 of the ladder rail 50 will reside within the interior of the channel member 12 and be interposed between the bracket 14 and the inner surfaces of the walls of the channel member 12. It can be seen that the bracket 14 is properly installed within the channel member 12 prior to attachment to the rail 50.

Figure 9:
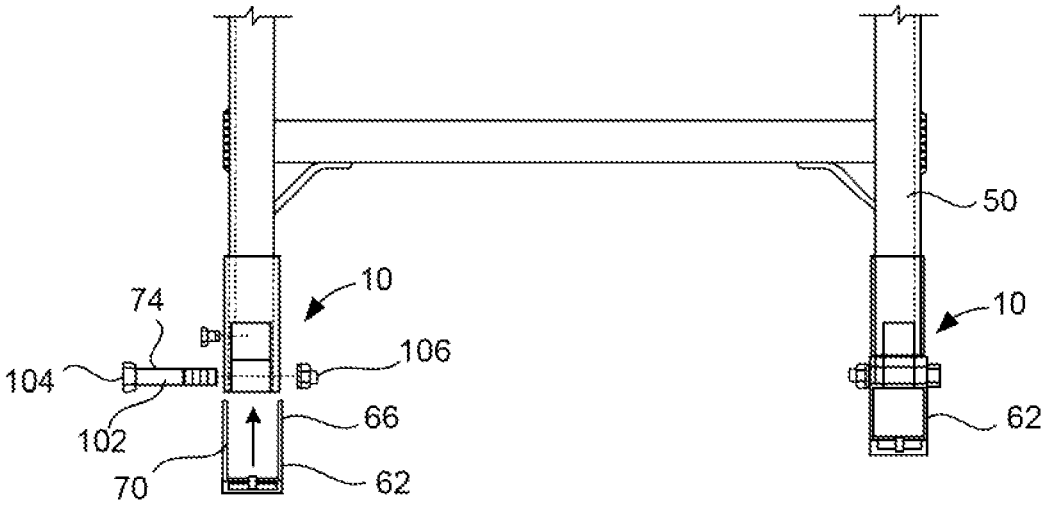
FIG. 9 illustrates a further step in the assembly of the shoe bracket assembly of the present invention to the bottom edge of the ladder rail.

FIG. 9 illustrates the attachment of the foot 62 subsequent to the attachment of the bracket assembly 10 to the bottom edge 100 of the ladder rail 50. In particular, the surfaces 66 and 70 can move upwardly so as to be placed against the outer surfaces of the shoe bracket assembly 10. The axle 74 is then inserted through the holes 32 and 34 formed respectively in the channel member 12 and the bracket 14. As such, the present invention avoids any need of forming holes in the lower portion of the ladder rail 50. The axle 74 is illustrated as being in the nature of a bolt 102 having a head 104 at one end thereof. A nut 106 will be threadedly affixed to the opposite end of the bolt 102. As such, the head 104 will bear against the first surface 70 of the foot 62. The nut 106 will bear against the second surface 66 of the foot 62.

Upon assembly, the shoe bracket assembly 10, along with the foot 62 will be properly secured to the bottom of the rail 50 of the ladder.

The present invention achieves significant advantages over the prior art. Fundamentally, since no modification is necessary in the bottom of the ladder rail, the structural integrity of the bottom end of the ladder rail is maintained. Assembly is simplified since it is only necessary to insert the assembled bracket assembly onto the lower end of the ladder rail. If repair is necessary, this bracket assembly can be easily removed by separating the rivets from the structures of the ladder and from the structures of the bracket assembly. The shoe can be easily and strongly attached by a bolt. The proper positioning of the end edge of the ladder rail is assured because of the placement of the shoulder within the bracket. Additionally, the structural integrity of the end of the ladder rail is enhanced because of its sandwiched configuration between the strong structures associated with the bracket and the channel member. The placement of the end edge of the ladder rail a sufficient distance above the foot further avoids any potential damaging contact between the foot and the end edge of the ladder rail.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A shoe bracket assembly for attachment to a bottom of a rail ladder, the shoe bracket assembly comprising:

a channel member having a side wall and a first end wall and a second end wall, said first end wall and said second end wall extending in generally transverse relationship to said side wall, said channel member having a hole formed therethrough; and a bracket affixed to said side wall of said channel member and positioned between said end walls of said channel member, said bracket having a central portion having a first flange and a second flange extending outwardly therefrom, said first flange and said second flange affixed to said side wall of said channel member, said bracket having a third flange and a fourth flange extending outwardly from said central portion, said third flange and said fourth flange positioned in spaced relation to said side wall so as to define a space therebetween, said third flange and said fourth flange extending in a plane that is in parallel relation to a plane of said first and second flanges, said central portion having a hole formed therethrough in axial alignment with said hole of said channel member.

2. The shoe bracket assembly of claim 1, said central portion of said bracket having a shoulder formed thereon in a location adjacent said first and second flanges.

3. The shoe bracket assembly of claim 1, said first and second flanges being riveted to said side wall of said channel member.

4. The shoe bracket assembly of claim 1, said third and fourth flanges each having a hole formed therethrough.

5. The shoe bracket assembly of claim 1, further comprising:

a foot having a bottom surface, said foot having a first surface and a second surface extending upwardly from said bottom surface, each of said first and second surfaces having an opening formed therein, said first surface positioned adjacent a side wall of said channel member, said second surface positioned adjacent said central portion of said bracket; and an axle extending through said openings of said first and second surfaces and through said hole in said side wall of said channel member and through said hole in said central portion of said bracket.

6. The shoe bracket assembly of claim 5, each of said first and second openings comprising an elongated slot extending along the respective surfaces of said foot.

7. The shoe bracket assembly of claim 5, said axle comprising a bolt having a head bearing against one of said first and second surfaces and a nut bearing against the other of said first and second surfaces.

8. The shoe bracket assembly of claim 6, said foot having a bottom surface, said elongated slot having a longitudinal axis extending at a non-transverse acute angle with respect to said bottom surface.

9. The shoe bracket assembly of claim 1, said foot having a polymeric or elastomeric gripping surface affixed to a bottom thereof.

10. A ladder assembly comprising:

a rail having a bottom edge, said rail having a first end side and a second end side and a central side formed between said first and second end sides;

a channel member having a side wall and a first end wall and a second end wall, said first end wall and said second end wall extending in generally transverse relation to said side wall, said channel member having a hole formed therethrough; and a bracket affixed to said side wall of said channel member and positioned between said end walls of said channel member, said bracket having a central portion having a first flange and a second flange extending outwardly therefrom, said first flange and said second flange affixed to said side wall of said channel member, said bracket having a third flange and a fourth flange extending outwardly from said central portion, said third flange and said fourth flange positioned in spaced relation to said side wall so as to define a space therebetween, said central side of said rail positioned in said space, said third flange and said fourth flange extending in a plane that is in parallel relation to a plane of said first and second flanges, said central portion having a hole formed therethrough in axial alignment with said hole of said channel member, said bottom edge of said rail positioned within said space.

11. The ladder assembly of claim 10, said side wall of said channel member having a first hole and a second hole formed therein, said third and fourth flanges each having a hole formed therein, said first and second holes of said channel member aligned respectively with said holes of said third and fourth flanges.

12. The ladder assembly of claim 11, further comprising:

a first fixing member extending through said central side of said rail and through said first hole of said channel member and through the hole of said third flange; and a second fixing member extending through said central side of said rail and through said second hole of said channel member and through the hole of said fourth flange.

13. The ladder assembly of claim 10, said side wall of said channel member being riveted to said central side of said rail.

14. The ladder assembly of claim 10, said central portion of said bracket having a shoulder formed thereon in a location adjacent said first and second flanges, said bottom edge of said rail bearing against said shoulder of said bracket.

15. The ladder assembly of claim 10, said hole of said central portion of said bracket and said hole of said channel member positioned below and in spaced relation to said bottom edge of said rail.

16. The ladder assembly of claim 10, further comprising:

a foot having a bottom surface, said foot having a first surface and a second surface extending upwardly from said bottom surface, each of said first and second surfaces having an opening formed therein, said first surface positioned adjacent a side wall of said channel member, said second surface positioned adjacent said central portion of said bracket; and an axle extending through said openings of said first and second surfaces and through said hole in said side wall of said channel member and through said hole in said central portion of said bracket.

17. The ladder assembly of claim 16, each of said first and second openings comprising an elongated slot extending along the respective surfaces of said foot.

18. The ladder assembly of claim 16, said axle comprising a bolt having a head bearing against one of said first and second surfaces and a nut bearing against the other of said first and second surfaces.

19. The ladder assembly of claim 16, said foot having a bottom surface, said elongated slot having a longitudinal axis extending at a non-transverse acute angle with respect to said bottom surface.

20. The ladder assembly of claim 16, said foot having a polymeric or elastomeric gripping surface affixed to a bottom thereof.

* * * * *